US011161049B2

(12) United States Patent
Loudon et al.

(10) Patent No.: US 11,161,049 B2
(45) Date of Patent: Nov. 2, 2021

(54) CAROUSEL RIDE SYSTEMS AND METHODS

(71) Applicant: Universal City Studios LLC, Universal City, CA (US)

(72) Inventors: Jerrell Andrew Loudon, Orlando, FL (US); David Wayne Komives, Rockledge, FL (US); Elizabeth Teresa Colon, Winter Park, FL (US); Francis K. Weigand, La Canada, CA (US); Michael Gordon, Glendale, CA (US); Arthur Derby Ahlstone, Ventura, CA (US); Daniel Coats, Alamo, CA (US); Brad Borgman, Mercer Island, WA (US); Dave Clare, Olympia, WA (US)

(73) Assignee: Universal City Studios LLC, Universal City, CA (US)

( * ) Notice: Subject to any disclaimer, the term of this patent is extended or adjusted under 35 U.S.C. 154(b) by 0 days.

(21) Appl. No.: 16/821,448

(22) Filed: Mar. 17, 2020

(65) Prior Publication Data

US 2020/0298132 A1 Sep. 24, 2020

Related U.S. Application Data

(60) Provisional application No. 62/820,092, filed on Mar. 18, 2019.

(51) Int. Cl.
*A63G 1/30* (2006.01)
*A63G 1/34* (2006.01)

(52) U.S. Cl.
CPC *A63G 1/30* (2013.01); *A63G 1/34* (2013.01)

(58) Field of Classification Search
CPC ..... A63G 1/34; A63G 1/30; A63G 7/00
USPC ..... 472/39–37, 29–37
See application file for complete search history.

(56) References Cited

U.S. PATENT DOCUMENTS

| | | | | |
|---|---|---|---|---|
| 1,399,582 | A | 12/1921 | Sayih | |
| 2,509,944 | A | 5/1950 | Skelley | |
| 3,356,365 | A | 12/1967 | Shano | |
| 3,840,225 | A | 10/1974 | Fouché | |
| 3,985,352 | A | 10/1976 | Nitzsche | |
| 4,973,042 | A | 11/1990 | Klopf et al. | |
| 5,617,658 | A * | 4/1997 | Chen | G09F 19/08 40/411 |

(Continued)

FOREIGN PATENT DOCUMENTS

GB 189916 12/1922

OTHER PUBLICATIONS

PCT/US2020/023271 Invitation to Pay Additional Fees dated Jun. 8, 2020.

(Continued)

*Primary Examiner* — Kien T Nguyen
(74) *Attorney, Agent, or Firm* — Fletcher Yoder, P.C.

(57) ABSTRACT

A carousel ride system includes a rotatable platform, a plurality of figures that are configured to rotate with the rotatable platform, and a lift system. The lift system is configured to raise and to lower the plurality of figures relative to the rotatable platform along a vertical axis during ride operations and to position each of the plurality of figures at a same vertical height relative the rotatable platform along the vertical axis during loading and unloading operations.

20 Claims, 12 Drawing Sheets

(56) References Cited

U.S. PATENT DOCUMENTS

| | | | |
|---|---|---|---|
| 8,313,389 | B2 | 11/2012 | Crawford et al. |
| 8,517,848 | B2 | 8/2013 | Crawford et al. |

OTHER PUBLICATIONS

"Carousel Type Rides", Website: https://www.sansei-technologies.com/eng/product/play/spin_ride.php, p. 1 (Accessed on Mar. 17, 2020).
"Enterprise 2G/2GH| Huss Park Attractions", Website:https://www.hussrides.com/en/classic-rides/enterprise-2g2gh, pp. 1-6, 2020 (Accessed on Mar. 13, 2020).
"Flying Carousel", Website: https://www.zamperla.com/products/flying-carousel/, pp. 1-5 (Accessed on Mar. 13, 2020).
"Octopus", Website:https://www.fabbrigroup.com/wp-content/uploads/2017/04/Octopus.jpg, pp. 1-4, 2017 (Accessed on Mar. 13, 2020).
"The SeaStorm Ride", Website:https://mack-rides.com/products/spin-rides/seastorm-ride/, pp. 1-4, 2017 (Accessed on Mar. 13, 2020).
"Sombrero", Website: https://www.zamperla.com/products/sombrero/, pp. 1-4 (Accessed on Mar. 13, 2020).
"Space Trainer", Website:https://www.moserrides.com/privacy-policy/:, pp. 1-3, 2017 (Accessed on Mar. 17, 2020).
"Top Spin® Suspended | Huss Park Attractions", Website:https://www.hussrides.com/en/classic-rides/top-spin-suspended , pp. 1-3, 2020 (Accessed on Mar. 17, 2020).
"WindSeeker", Website:https://en.wikipedia.org/wiki/WindSeeker, pp. 1-12, Feb. 11, 2020 (Accessed on Mar. 13, 2020).

* cited by examiner

CAROUSEL RIDE SYSTEMS AND METHODS

CROSS-REFERENCE TO RELATED APPLICATION

This application claims priority to and the benefit of U.S. Provisional Application No. 62/820,092, entitled "CAROUSEL RIDE SYSTEMS AND METHODS," filed Mar. 18, 2019, which is hereby incorporated by reference in its entirety for all purposes.

BACKGROUND

The present disclosure relates generally to the field of carousel ride systems and methods for amusement parks.

Amusement parks may have various entertainment attractions. One type of entertainment attraction may be a carousel ride system with a rotatable platform. The carousel ride system may include multiple figures (e.g., seats for riders) that rotate with the rotatable platform. In some carousel ride systems, the multiple figures may move up and down relative to the rotatable platform as the multiple figures rotate with the rotatable platform.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

SUMMARY

Certain embodiments commensurate in scope with the originally claimed subject matter are summarized below. These embodiments are not intended to limit the scope of the disclosure, but rather these embodiments are intended only to provide a brief summary of certain disclosed embodiments. Indeed, the present disclosure may encompass a variety of forms that may be similar to or different from the embodiments set forth below.

In an embodiment, a carousel ride system includes a rotatable platform, a plurality of figures that are configured to rotate with the rotatable platform, and a lift system. The lift system is configured to raise and to lower the plurality of figures relative to the rotatable platform along a vertical axis during ride operations and to position each of the plurality of figures at a same vertical height relative the rotatable platform along the vertical axis during loading and unloading operations.

In an embodiment, a method of operating a carousel ride system includes positioning, using a lift system, a plurality of figures at a same vertical height relative to a rotatable platform along a vertical axis during loading operations. The method also includes moving, using the lift system, the plurality of figures up and down relative to the rotatable platform along the vertical axis during rotation of the rotatable platform and the plurality of figures during ride operations. The method further includes positioning, using the lift system, the plurality of figures to the same vertical position relative to the rotatable platform along the vertical axis during unloading operations.

In an embodiment, a carousel ride system includes a rotatable platform, a plurality of figures that are configured to rotate with the rotatable platform, and a lift system. The lift system includes a controller that is configured to control one or more actuators of the lift system to adjust one or more components of the lift system to cause the plurality of figures to repeatedly move up and down relative to the rotatable platform along a vertical axis during ride operations and to cause the plurality of figures to be at a same vertical height relative to the rotatable platform during loading and unloading operations.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
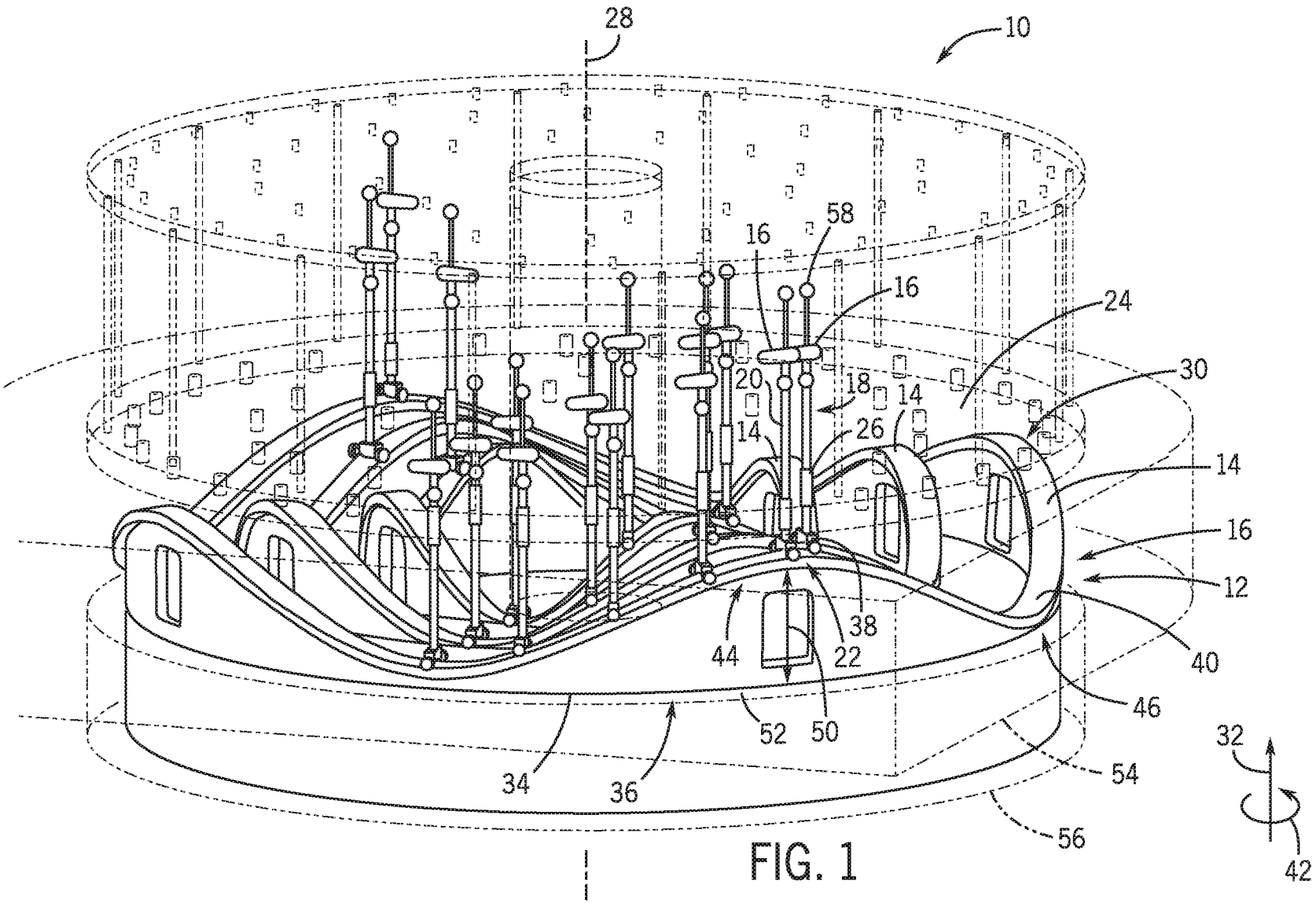
FIG. 1 is a perspective view of an embodiment of a carousel ride system that includes a lift system having one or more annular tracks, in accordance with an embodiment of the present disclosure.

One or more specific embodiments will be described below. In an effort to provide a concise description of these embodiments, not all features of an actual implementation are described in the specification. It should be noted that in the development of any such actual implementation, as in any engineering or design project, numerous implementation-specific decisions must be made to achieve the developers' specific goals, such as compliance with system-related and business-related constraints, which may vary from one implementation to another. Moreover, it should be noted that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. One or more specific embodiments of the present embodiments described herein will be described below. In an effort to provide a concise description of these embodiments, all features of an actual implementation may not be described in the specification. It should be noted that in the development of any such actual implementation, as in any engineering or design project, numerous implementation-specific decisions must be made to achieve the developers' specific goals, such as compliance with system-related and business-related constraints, which may vary from one implementation to another. Moreover, it should be noted that such a development effort might be complex and time consuming, but would nevertheless be a routine undertaking of design, fabrication, and manufacture for those of ordinary skill having the benefit of this disclosure.

The present disclosure is directed to carousel ride systems and methods for an amusement park. Carousel ride systems may include a rotatable platform and multiple figures (e.g., seats for riders) that rotate with the rotatable platform. The multiple figures may move up and down relative to the rotatable platform as the multiple figures rotate with the rotatable platform. In traditional systems, the multiple figures may be at various vertical heights relative to the rotatable platform during loading and unloading of the riders. It is now recognized that such existing systems may cause delays in loading and unloading of the riders and/or cause certain figures of the multiple figures to be less desirable to riders. For example, some riders may have difficulty climbing onto or off of any of the multiple figures that are in a raised position (e.g., highest position).

Accordingly, certain disclosed embodiments relate to carousel ride systems and methods that position the multiple figures at a same vertical height relative to the rotatable platform during loading and unloading of the riders. To accomplish this, the carousel ride systems may include a lift system that repeatedly moves the multiple figures up and down relative to the rotatable platform during ride operations (e.g., during rotation of the rotatable platform) and that positions the multiple figures at the same vertical height relative to the rotatable platform during loading and unloading operations (e.g., while the rotatable platform is stationary to enable riders to climb onto and off of the multiple figures).

With the foregoing in mind, FIG. 1 is a perspective view of an embodiment of a carousel ride system 10 that includes a lift system 12 having one or more annular tracks 14. As shown, the carousel ride system 10 also includes multiple FIG. 16 (e.g., seats for riders) each supported by or mounted on a respective support system 18 that includes a respective support post 20 (e.g., rigid post) and a respective bogie 22. The carousel ride system 10 also includes a rotatable platform 24 on which the riders travel (e.g., walk) to reach the multiple FIG. 16 during loading and unloading operations. Each support post 20 extends through a respective opening 26 in the rotatable platform 24, and thus, rotation of the rotatable platform 24 about an axis of rotation 28 (e.g., center axis) drives rotation of the multiple FIG. 16. To facilitate discussion and image clarity, only some of the multiple FIG. 16 and corresponding components (e.g., support systems 18) are illustrated in FIG. 1. However, it should be appreciated that the multiple FIG. 16 and corresponding components may be distributed at various locations about the rotatable platform 24.

In the illustrated embodiment, the lift system 12 is in a ride position 30 (e.g., raised position) in which the one or more annular tracks 14 are raised relative to the rotatable platform 24 along a vertical axis 32 of the carousel ride system 10. The vertical axis 32 may be parallel to the axis of rotation 28. As shown, in the ride position 30, each of the one or more annular tracks 14 may extend through a respective annular gap 34 formed in a support frame 36 of the lift system 12. For example, at least a portion of each of the one or more annular tracks 14 may be raised relative to the support frame 36 along the vertical axis 32. In the ride position 30, the bogies 22 may be supported on the one or more annular tracks 14. Additionally, during rotation of the rotatable platform 24 during ride operations, each of the bogies 22 may move along the one or more annular tracks 14. For example, each of the bogies 22 may include one or more wheels 38 (e.g., center wheels) that contact a surface 40 (e.g., upper surface) of the one or more annular tracks 14 while the one or more annular tracks 14 are in the ride position 30, and then the one or more wheels 38 may move (e.g., roll) along the surface 40 of the one or more annular tracks 14 during rotation of the rotatable platform 24 during ride operations.

As shown, the one or more annular tracks 14 may have undulations that extend circumferentially (e.g., along a circumferential axis 42) about the one or more annular tracks 14. The undulations cause the multiple FIG. 16 to move up and down along the vertical axis 32 relative to the rotatable platform 24 during ride operations. For example, rotation of the rotatable platform 24 drives rotation of the multiple FIG. 16 and the attached respective support systems 18, thereby causing the bogies 22 to move along the undulations of the one or more annular tracks 14 to cause the multiple FIG. 16 to move up and down along the vertical axis 32 relative to the rotatable platform 24.

The undulations may form any number (e.g., 1, 2, 3, 4, 5, 6, or more) of peak regions 44 and valley regions 46. In the illustrated embodiment, each peak region 44 includes a first height 50 relative to the support frame 36 and/or valley regions 46 along the vertical axis 32. However, it should be appreciated that the peak regions 44 have varying heights relative to the support frame 36 and/or valley regions 46 along the vertical axis 32. Furthermore, in the illustrated embodiment, the valley regions 46 are generally flush with a surface 52 (e.g., upper surface) of the support frame 36. However, it should be appreciated that some or all of the valley regions 46 may be offset (e.g., raised or lowered, by the same or varying degrees) relative to the surface 52 of the support frame 36 along the vertical axis 32.

The lift system 12 may be generally hidden from the view of the riders. For example, the one or more annular tracks 14, the support frame 36, and at least a portion of the support system 18 (e.g., the bogies 22) are positioned vertically below the rotatable platform 24, enclosed or covered by a cover 54, and/or positioned within a receptacle 56 (e.g., opening or hole) formed in the ground. Thus, as the riders approach the carousel ride system 10, travel across the rotatable platform 24 during loading and unloading operations, and ride on the multiple FIG. 16 during ride operations, the riders may not see at least the one or more annular tracks 14, the support frame 36, and at least a portion of the support system 18 (e.g., the bogies 22). While at least some portions of the rotatable platform 24, the cover 54, and the ground surrounding the receptacle 56 are shown as generally transparent to facilitate discussion and to enable visualization of components of the lift system 12, it should be appreciated that the rotatable platform 24, the cover 54, and the ground surrounding the receptacle 56 may not be transparent in order to hide the components of the lift system 12.

While three annular tracks 14 are shown in the illustrated embodiment, it should be appreciated that any suitable number (e.g., 1, 2, 3, 4, 5, or more) of annular tracks 14 may be provided. Additionally, while the carousel ride system 10 may include a handle 58 or other structure for the rider to hold during the ride operations, the carousel ride system 10 may be devoid of any support posts that extend vertically above the multiple FIG. 16. For example, the multiple FIG. 16 may only be supported by the respective support posts 20 that extend vertically below the multiple FIG. 16, and the multiple FIG. 16 may not be supported by any support posts that are suspended from a ceiling or frame structure vertically above the multiple FIG. 16. However, in some embodiments, the carousel ride system 10 may include supports posts that extend vertically above the multiple FIG. 16 and that are suspended from or extend through a ceiling or frame structure vertically above the multiple FIG. 16.

Figure 2:
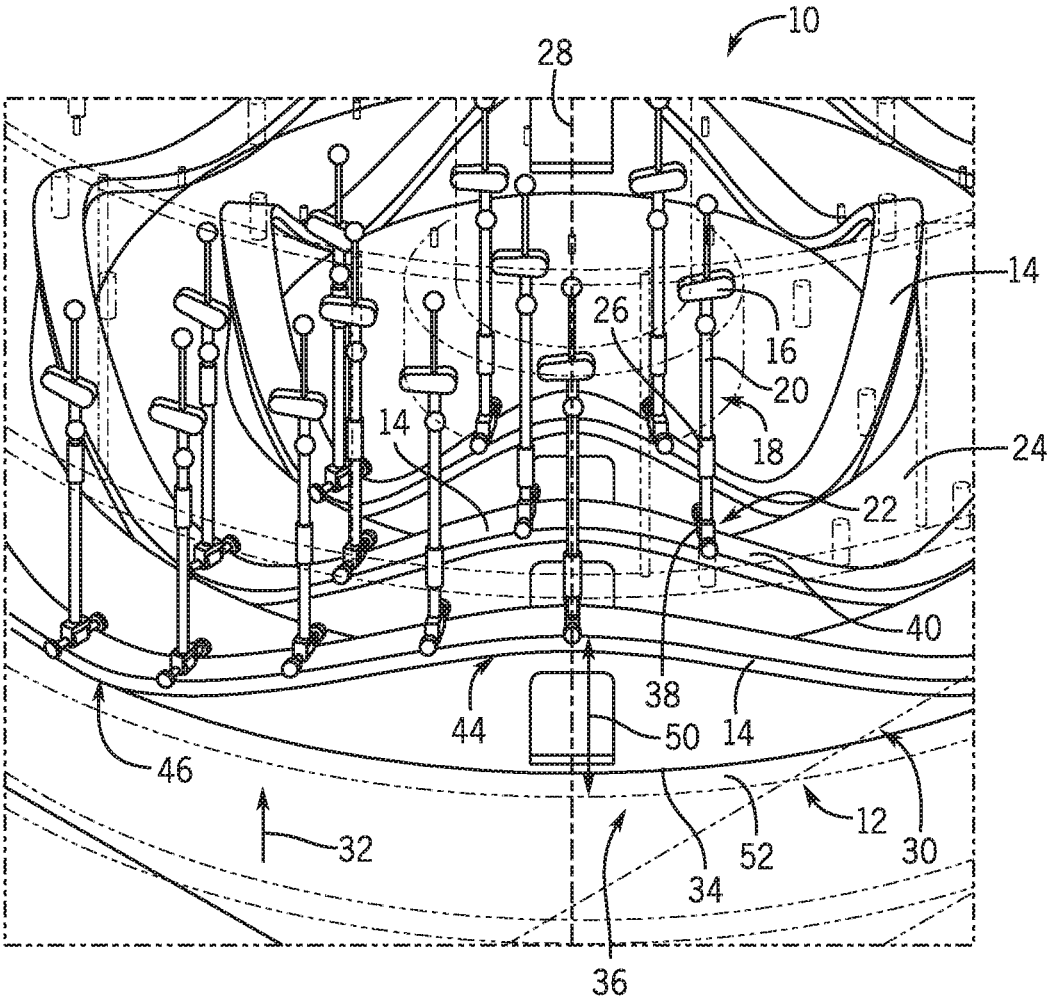
FIG. 2 is a perspective view of a portion of the carousel ride system of FIG. 1 with the lift system in a ride position, in accordance with an embodiment of the present disclosure.

FIG. 2 is a perspective view of a portion of the carousel ride system 10 of FIG. 1 with the lift system 12 in the ride position 30. As shown, the multiple FIG. 16 are each supported by or mounted on the respective support system 18 that includes the respective support post 20 and the respective bogie 22. Each support post 20 extends through the respective opening 26 in the rotatable platform 24.

As shown, in the ride position 30, each of the one or more annular tracks 14 may extend vertically above the respective annular gap 34 formed in the support frame 36 and the bogies 22 may be supported on the one or more annular tracks 14. Additionally, during rotation of the rotatable platform 24 during ride operations, each of the bogies 22 may move along the one or more annular tracks 14 (e.g., via the one or more wheels 38 that contact and move along the surface 40 of the one or more annular tracks 14).

The one or more annular tracks 14 may have undulations that cause the multiple FIG. 16 to move up and down relative to the rotatable platform 24 along the vertical axis 32 during ride operations. The undulations may include the peak regions 44 and the valley regions 46. In the illustrated embodiment, each peak region 44 includes the first height 50 relative to the support frame 36 and/or valley regions 46 along the vertical axis 32, and the valley regions 46 are generally flush with the surface 52 of the support frame 36. However, the peak regions 44 and the valley regions 46 may have any of a variety of shapes and dimensions.

Figure 3:
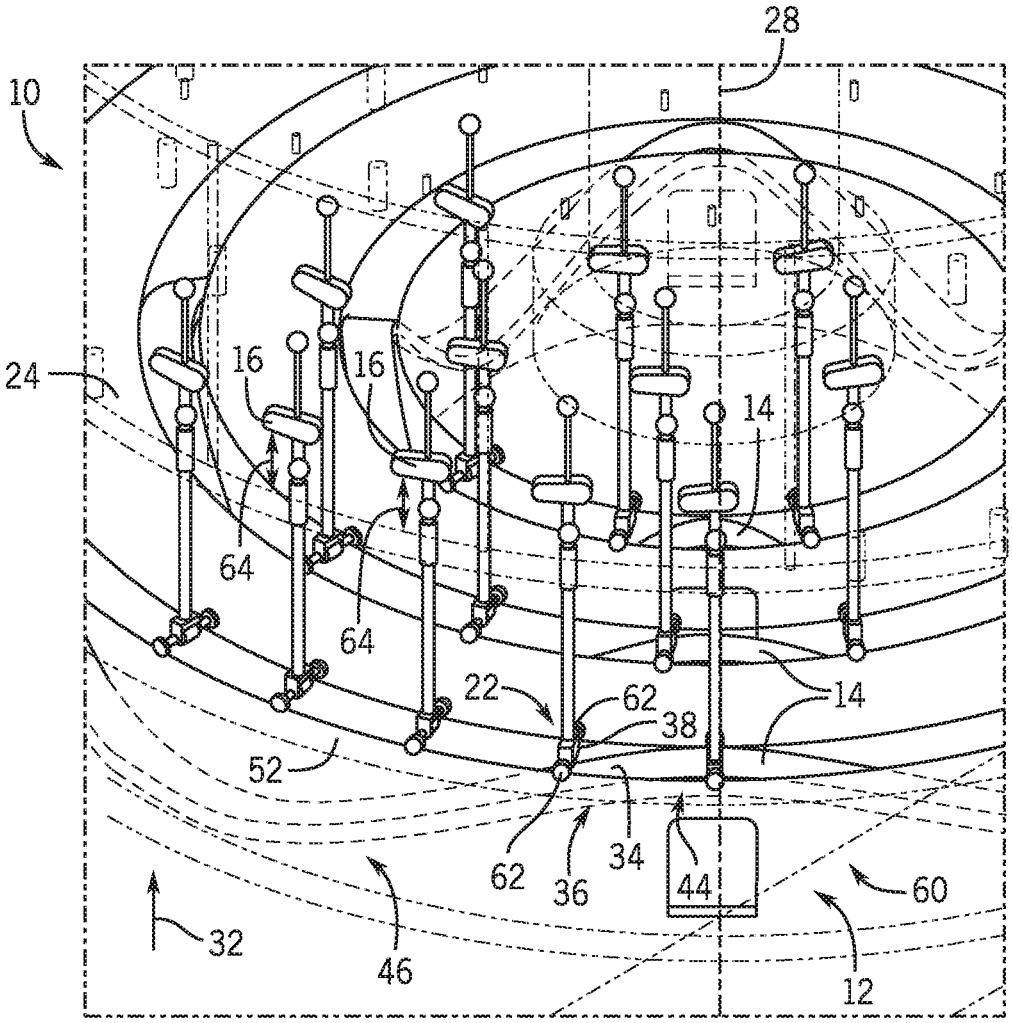
FIG. 3 is a perspective view of the portion of the carousel ride system of FIG. 2 with the lift system in a load/unload position, in accordance with an embodiment of the present disclosure.

FIG. 3 is a perspective view of the portion of the carousel ride system 10 of FIG. 2 with the lift system 12 in a load/unload position 60 (e.g., lowered position). In the load/unload position 60, the one or more annular tracks 14 are lowered relative to the rotatable platform 24 along the vertical axis 32. As shown, in the load/unload position 60, each of the one or more annular tracks 14 are withdrawn from the respective annular gap 34 formed in the support frame 36. That is, each of the one or more annular tracks 14 is lowered relative to the support frame 36 along the vertical axis 32.

In the load/unload position 60, the bogies 22 may be supported on the support frame 36. For example, each of the bogies 22 may include one or more wheels 62 (e.g., outer wheels) that contact the surface 52 of the support frame 36. Furthermore, in the load/unload position 60, the one or more wheels 38 may not be supported on and/or may not contact the one or more annular tracks 14. Because the surface 52 of the support frame 36 is a flat surface that is parallel to the rotatable platform 24 and that is orthogonal relative to the vertical axis 32, each of the multiple FIG. 16 may be at a same vertical height 64 relative to the rotatable platform 24 along the vertical axis 32 while the lift system 12 is in the load/unload position 60.

In operation, the carousel ride system 10 may continuously move between loading operations, ride operations, and unloading operations. The disclosed lift system 12 may enable efficient transition between loading operations, ride operations, and unloading operations, such as by making it easier for riders to climb onto and off of the multiple FIG. 16. For example, during loading operations, the rotatable platform 24 may be stationary and the lift system 12 may be in the load/unload position 60 in which the one or more annular tracks 14 are withdrawn from the respective annular gaps 34 in the support frame 36. Thus, the multiple FIG. 16 are all at the same vertical height 64 relative to the rotatable platform 24 along the vertical axis 32.

Once the riders have climbed onto the multiple FIG. 16, the lift system 12 may adjust to the ride position 30 in which the one or more annular tracks 14 extend through the respective annular gaps 34 in the support frame 36 and extend vertically above the support frame 36 relative to the vertical axis 32. Due to the undulations of the one or more annular tracks 14, the multiple FIG. 16 will then be at varying vertical heights relative to the rotatable platform 24 (e.g., a first figure of the multiple FIG. 16 may be positioned at one of the peaks 44 and will be at a first height, and a second figure of the multiple figures may be positioned at one of the valleys 46 and will be at a second height, and/or a third figure of the multiple figures may be positioned between one of the peaks 44 and one of the valleys 46 and will be at a third height). The rotatable platform 24 may rotate, thereby driving rotation of the multiple FIG. 16 and causing the bogies 22 coupled to the multiple FIG. 16 to travel along the undulations of the one or more annular tracks 14. Accordingly, during the ride operations, the multiple FIG. 16 may rotate with the rotatable platform 24 and may also move up and down relative to the rotatable platform 24 along the vertical axis 32. Following the ride operations, the rotatable platform 24 may cease rotating and may move to a stationary position for unloading operations. Then, the lift system 12 may adjust to the load/unload position 60 in which the one or more annular tracks 14 are withdrawn from the respective annular gaps 34 in the support frame 36. Thus, the multiple FIG. 16 (e.g., all the multiple FIG. 106 that were raised and lowered by the lift system 12 during the ride operations) are all at the same vertical height 64 relative to the rotatable platform 24 along the vertical axis 32 to facilitate unloading of the carousel ride system 10.

It should be appreciated that the above-described steps to transition between the loading operations, the ride operations, and the unloading operations may be carried out in any suitable order and/or simultaneously. For example, once the riders have climbed onto the multiple FIG. 16, the rotatable platform 24 may rotate prior to or while the lift system 12 adjusts to the ride position 30. Similarly, following the ride operations, the rotatable platform 24 may cease rotation or slow rotation after or while the lift system 12 adjusts to the load/unload position 60.

Additionally, it should be appreciated that the rotation of the rotatable platform 24 and the adjustment of the lift system 12 may be coordinated and controlled by a control system (e.g., electronic control system). For example, with reference to FIG. 4, a control system 70 may include a controller 72 having a processor 74 and a memory device 76. The controller 72 may provide control signals to one or more actuators 78 (e.g., linear actuators) to adjust the lift system 12 between the illustrated ride position 30 and the load/unload position 60 (FIG. 3). The controller 72 may also provide control signals to one or more actuators 80 to drive rotation of the rotatable platform 24. The controller 72 may be configured to receive inputs via an input device 82 (e.g., from a ride operator) and to provide the control signals to the actuators 78, 80 in response to the inputs. For example, the controller 72 may receive an input that indicates that the riders have climbed onto the multiple FIG. 16 and that the loading operations are complete. In response, the controller 72 may provide the control signals to the one or more actuators 78 to adjust the lift system 12 to the ride position 30, and then at some subsequent time (e.g., after the lift system 12 reaches the ride position 30) the controller 72 may provide the control signals to the one or more actuators 80 to drive rotation of the rotatable platform 24. As noted above, the steps to transition between the loading operations and the ride operations may be carried out in any suitable order and/or simultaneously. For example, in response to receipt of the input that the loading operations are complete, the controller 72 may provide the control signals to the actuators 80 to drive rotation of the rotatable platform 24 prior to or while the lift system 12 adjusts to the ride position 30.

Certain steps may be automated and/or controlled on a timer (e.g., timed schedule). For example, once rotation of the rotatable platform 24 commences, the rotation may continue for a time period (e.g., predetermined or operator-set time period, such as 1, 2, 3, 4, 5, or more minutes). When the time period ends, the controller 72 may provide the control signals to the one or more actuators 80 to stop rotation of the rotatable platform 24 and cause the rotatable platform 24 to assume a stationary position for unloading operations. Then, at some subsequent time (e.g., after the rotatable platform 24 is stationary), the controller 72 may provide the control signals to the one or more actuators 78 to adjust the lift system 12 to the load/unload position 60 in which the one or more annular tracks 14 are withdrawn from the respective annular gaps 34 in the support frame 36. As noted above, the steps to transition between the ride operations and the unloading operations may be carried out in any suitable order and/or simultaneously. For example, following the ride operations, the controller 72 may provide the control signals to the actuators 80 to stop or to slow rotation of the rotatable platform 24 after or while the lift system 12 adjusts to the load/unload position 60.

The memory device 76 may include one or more tangible, non-transitory, computer-readable media that store instructions executable by the processor 74 and/or data (e.g., time periods). For example, the memory device 76 may include random access memory (RAM), read only memory (ROM), rewritable non-volatile memory such as flash memory, hard drives, optical discs, and/or the like. Additionally, the processor 74 may include one or more general purpose microprocessors, one or more application specific processors (ASICs), one or more field programmable gate arrays (FPGAs), or any combination thereof.

Figure 4:
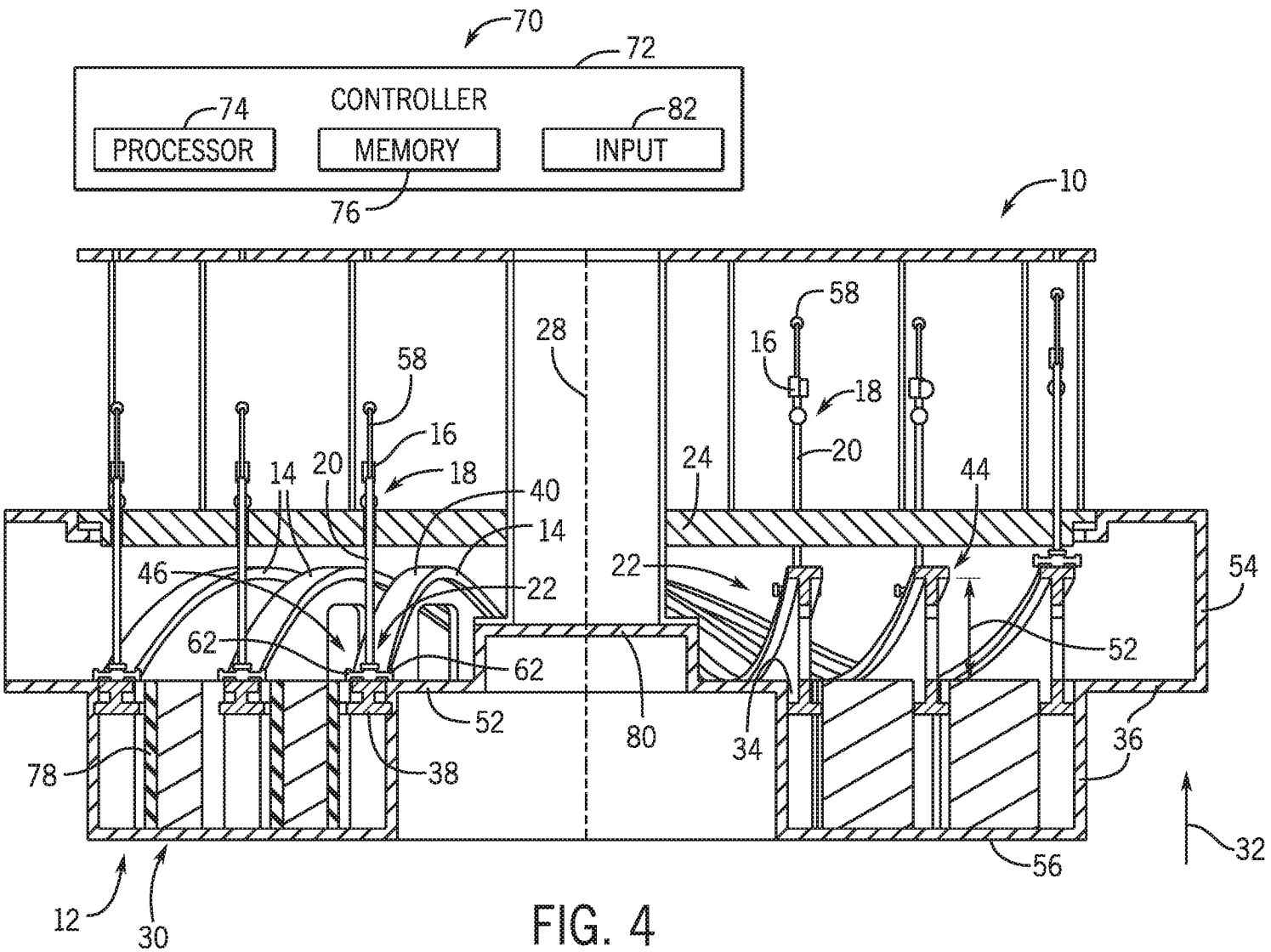
FIG. 4 is a side cross-sectional view of the carousel ride system of FIG. 1, in accordance with an embodiment of the present disclosure.

In addition to the control system 70 and the actuators 78, 80, FIG. 4 illustrates the various structural features of the carousel ride system 10 described above with respect to FIGS. 1-3. For example, FIG. 4 illustrates the multiple FIG. 16, the support systems 18 having the support posts 20 and the bogies 22, the rotatable platform 24, the cover 54, and the receptacle 56. FIG. 4 also illustrates the lift system 12 having the one or more annular tracks 14 and the support frame 36, for example. It should be appreciated that the various actuators 78, 80 are merely exemplary and any number and type of actuators may be positioned at any suitable locations about the carousel ride system 10 to enable the disclosed techniques.

Figure 5:
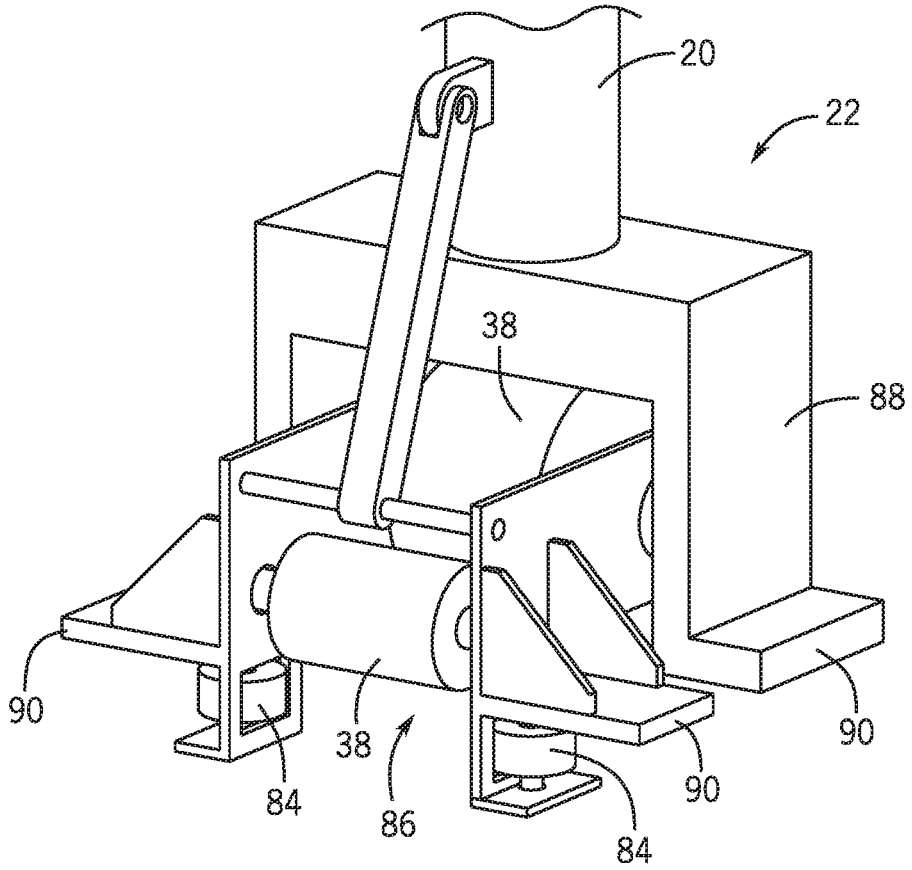
FIG. 5 is a perspective view of a bogie that may be used in the carousel ride system of FIG. 1, in accordance with an embodiment of the present disclosure.

FIG. 5 is a perspective view of an embodiment of one of the bogies 22 that may be used in the carousel ride system 10. As shown, the bogie 22 includes multiple wheels 38 (e.g., two wheels arranged one in front of the other) that are configured to contact an upper surface of a respective one of the annular tracks 14 (FIG. 4). The bogie 22 may also include multiple wheels 84 (e.g., two wheels arranged opposite to one another) that are configured to contact a side surface of the respective one of the annular tracks 14, thereby stabilizing the bogie 22 and the support post 20 coupled thereto during ride operations. The respective one of the annular tracks 14 may be received within a space 86 defined between the wheels 84 during ride operations. In the illustrated embodiment, the bogie 22 also includes a bogie frame 88 that is coupled to the support post 20 and that supports the wheels 38, 84 (e.g., rotatably on respective axles). The bogie 22 also includes feet 90 (e.g., laterally-extending feet; arranged on opposite lateral sides of the bogie frame 88) that extend laterally-outwardly of the wheels 38, 84 and have respective surfaces (e.g., lower surfaces) that are configured to contact and rest upon the surface 52 of the support frame 36 (FIG. 3) during the loading/unloading operations. While the feet 90 contact and rest upon the surface 52 of the support frame 36, the wheels 38 are separated from the upper surface of the respective one of the annular tracks 14, and thus, the bogie 22 is blocked from rolling and is maintained in a stationary position relative to the respective one of the annular tracks 14.

Figure 6:
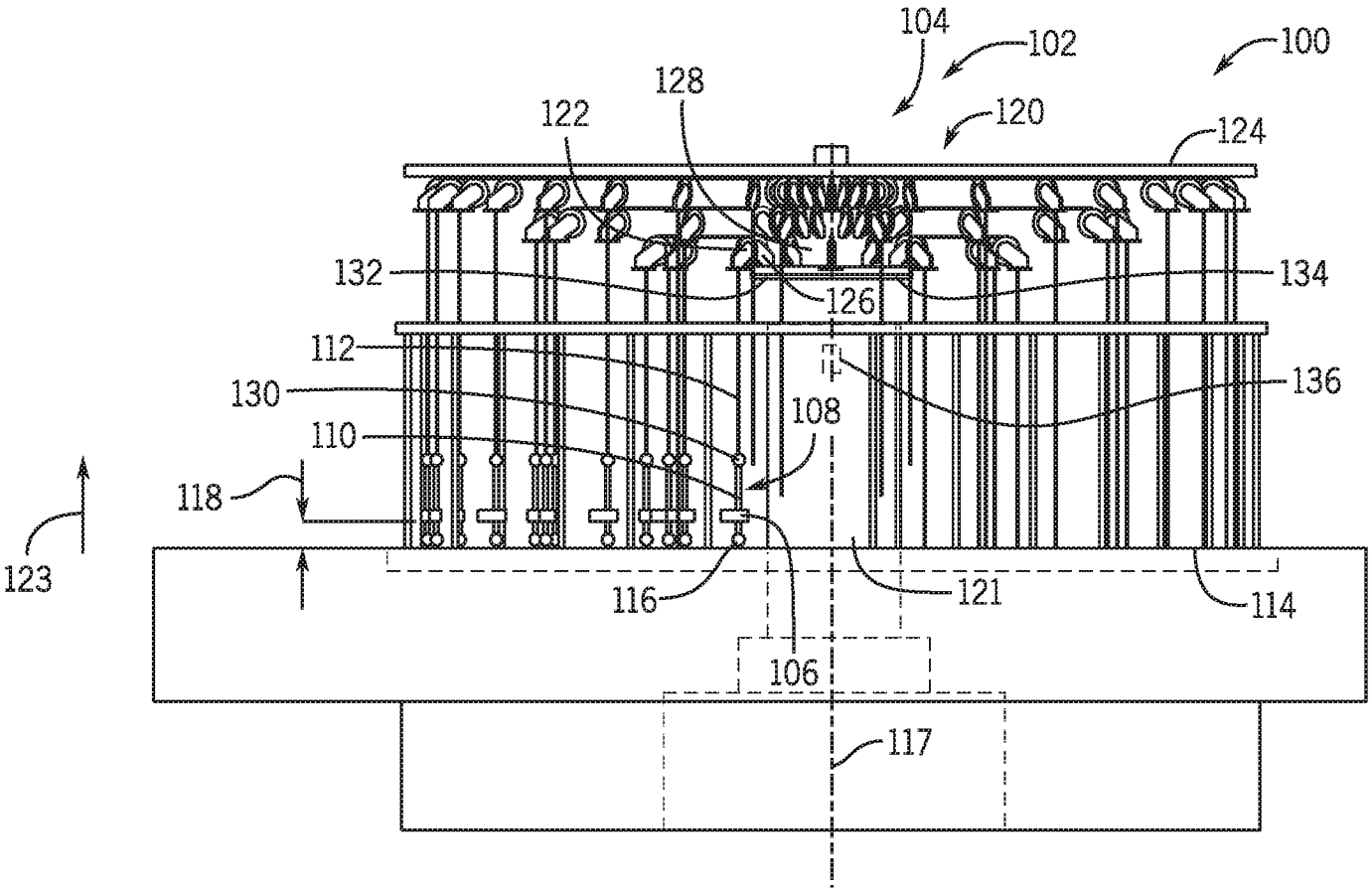
FIG. 6 is a side view of an embodiment of a carousel ride system that includes a lift system having a shuttle assembly, in accordance with an embodiment of the present disclosure.

FIG. 6 is a side view of an embodiment of a carousel ride system 100 that includes a lift system 102 having a shuttle assembly 104 (e.g., movable core). As shown, the carousel ride system 100 also includes multiple FIG. 106 (e.g., seats for riders) each supported by or mounted on a respective support system 108, which may include a respective support post 110 (e.g., rigid post) and/or a respective cable 112 (e.g., flexible cable). The carousel ride system 10 may also include a rotatable platform 114 on which the riders travel (e.g., walk) to reach the multiple FIG. 106 during loading and unloading operations. Each support post 110 may be coupled to the rotatable platform 114 and/or extend through a respective opening 116 in the rotatable platform 114, and thus, rotation of the rotatable platform 114 about an axis of rotation 117 (e.g., center axis) drives rotation of the multiple FIG. 106.

In the illustrated embodiment, the lift system 102 is in a load/unload position 120 (e.g., centered position) in which the shuttle assembly 104 is centered (e.g., coaxial) relative to the rotatable platform 114, the multiple FIG. 106, and/or a center post 121 of the carousel ride system 100. In the load/unload position 120, the multiple FIG. 106 may be at a same vertical height 118 relative to the rotatable platform 114 along a vertical axis 123 of the carousel ride system 100. The vertical axis 123 may be parallel to the axis of rotation 117. As shown, each of the cables 112 extends over a respective first pulley 122 (e.g., sheave, hook, loop) coupled to and suspended from a ceiling structure 124 (e.g., frame)

and a respective second pulley 126 (e.g., sheave, hook, loop) coupled to a support block 128 of the shuttle assembly 104. A respective first end 130 of each of the cables 112 may be coupled to the respective support post 110 and/or the respective FIG. 106, and a respective second end 132 of each of the cables 112 may be coupled to a plate 134 (e.g., lower plate, movable plate) of the shuttle assembly 104.

Figure 7:
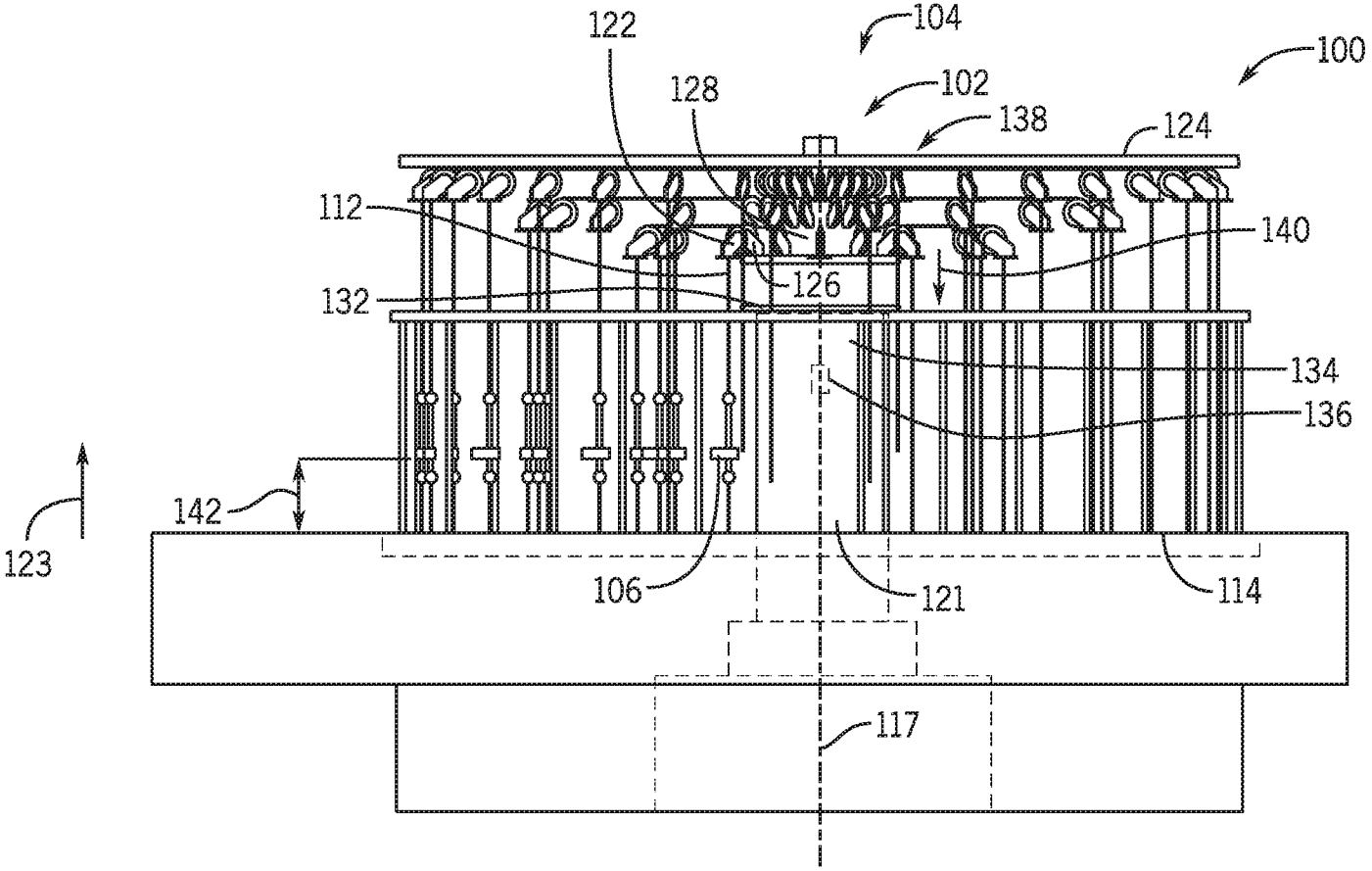
FIG. 7 is a side view of the carousel ride system of FIG. 6 with the lift system in an intermediate position, in accordance with an embodiment of the present disclosure.

In some embodiments, an actuator 136 may be provided to adjust a vertical position of the plate 134, which in turn adjusts the vertical height of each of the multiple FIG. 106 relative to the rotatable platform 114 along the vertical axis 123. For example, FIG. 7 is a side view of the carousel ride system 100 with the lift system 102 in an intermediate position 138. As shown, the actuator 136 may drive the plate 134 in the direction of an arrow 140 along the vertical axis 123 away from the support block 128 of the shuttle assembly 104 and toward the rotatable platform 114. Because the second ends 132 of the cables 112 are coupled to the plate 134, the cables 112 are pulled over the pulleys 122, 126, thereby raising the multiple FIG. 106 relative to the rotatable platform 114 along the vertical axis 123 (e.g., raising all of the multiple FIG. 106 simultaneously to another same vertical height 142 relative to the rotatable platform 114 along the vertical axis 123).

Figure 8:
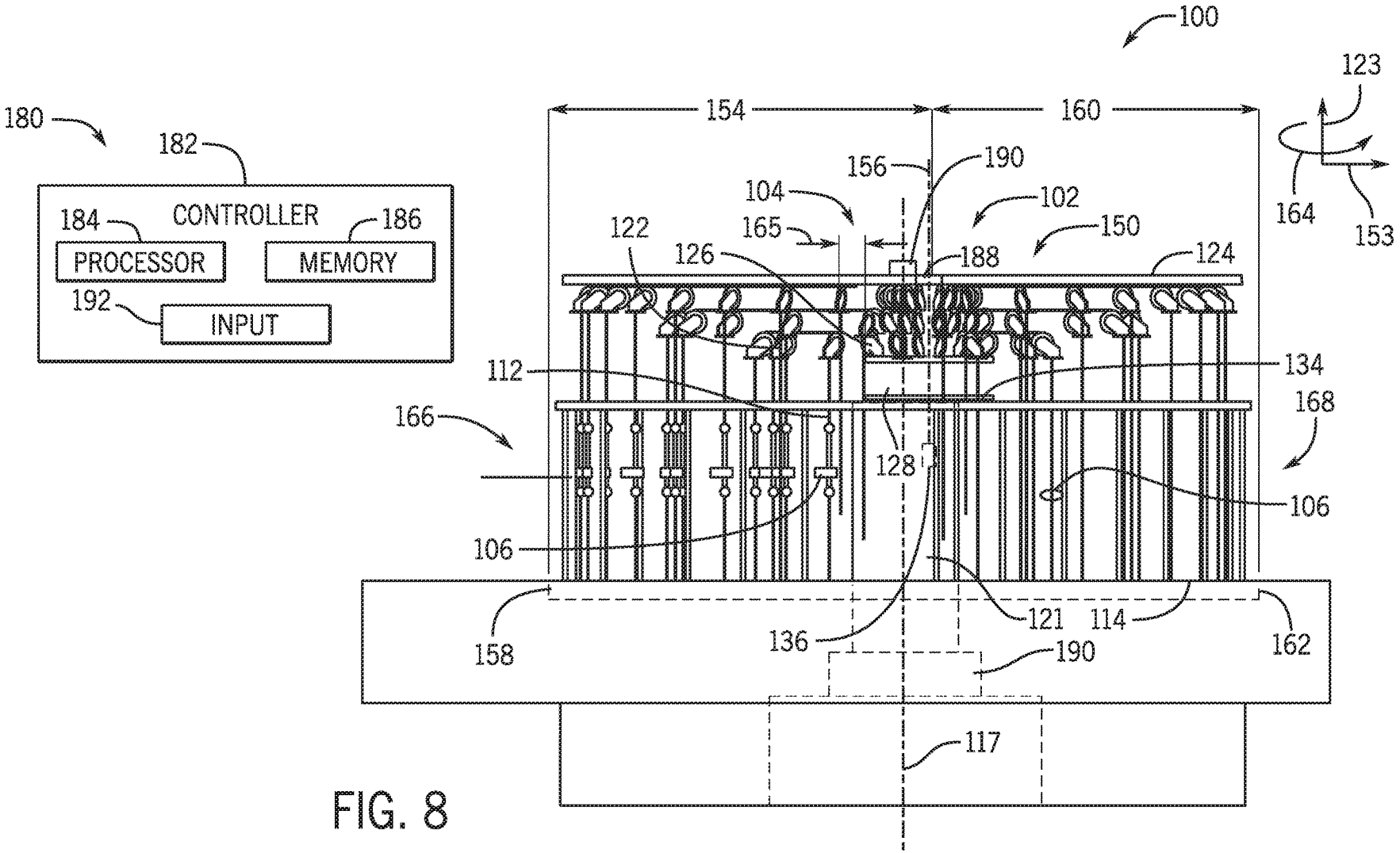
FIG. 8 is a side view of the carousel ride system of FIG. 6 with the lift system in a ride position, in accordance with an embodiment of the present disclosure.

Regardless of whether the multiple FIG. 106 are raised in the manner shown and described with respect to FIG. 7, the shuttle assembly 104 may move laterally relative to the rotatable platform 114 to cause the multiple FIG. 106 to move up and down relative to the rotatable platform 114 along the vertical axis 123 during rotation of the rotatable platform 114 during ride operations. For example, FIG. 8 is a side view of the carousel ride system 100 with the lift system 102 in a ride position 150 (e.g., laterally offset position). In the ride position 150, the shuttle assembly 104 is laterally offset relative to the rotatable platform 114, the multiple FIG. 106, and/or the center post 121 of the carousel ride system 100, along a lateral axis 153. For example, the shuttle assembly 104 may be shifted laterally, such that a first distance 154 from an axis of rotation 156 (e.g., center axis) of the shuttle assembly 104 to a first edge point 158 of the rotatable platform 114 is different than a second distance 160 from the axis of rotation 156 of the shuttle assembly 104 to a second edge point 162 of the rotatable platform 114 that is diametrically opposite from the first edge point 158. The shuttle assembly 104 may be shifted laterally, such that the axis of rotation 117 of the rotatable platform 114 and the axis of rotation 156 of the shuttle assembly 104 are no longer aligned (e.g., not coaxial).

During the ride operations, the shuttle assembly 104 (including the pulleys 122, 126), the multiple FIG. 106, the support systems 108, and the rotatable platform 114 may rotate together in a circumferential direction 164. During this rotation, a distance 165 between each respective pair of the pulleys 122, 126 varies due to the laterally offset position of the shuttle assembly 104 and the attached second pulleys 126. Thus, as the cables 112 slide along the pulleys 122, 126 during this rotation, the multiple FIG. 106 move up and down relative to the rotatable platform 114 along the vertical axis 123. For example, in the illustrated embodiment, the distance 65 between a first pair of the pulleys 122, 126 when on a first side 166 of the shuttle assembly 104 is greater than the distance 65 between the first pair of the pulleys 122, 126 when on a second side 168 of the shuttle assembly 104. Accordingly, each of the multiple FIG. 106 will be in a raised positioned (e.g., highest position relative to the rotatable platform 114) when on the first side 166 of the shuttle assembly 104 and will be in a lowered positioned (e.g., lowest position relative to the rotatable platform 114) when on the second side 168 of the shuttle assembly 104.

Figure 9:
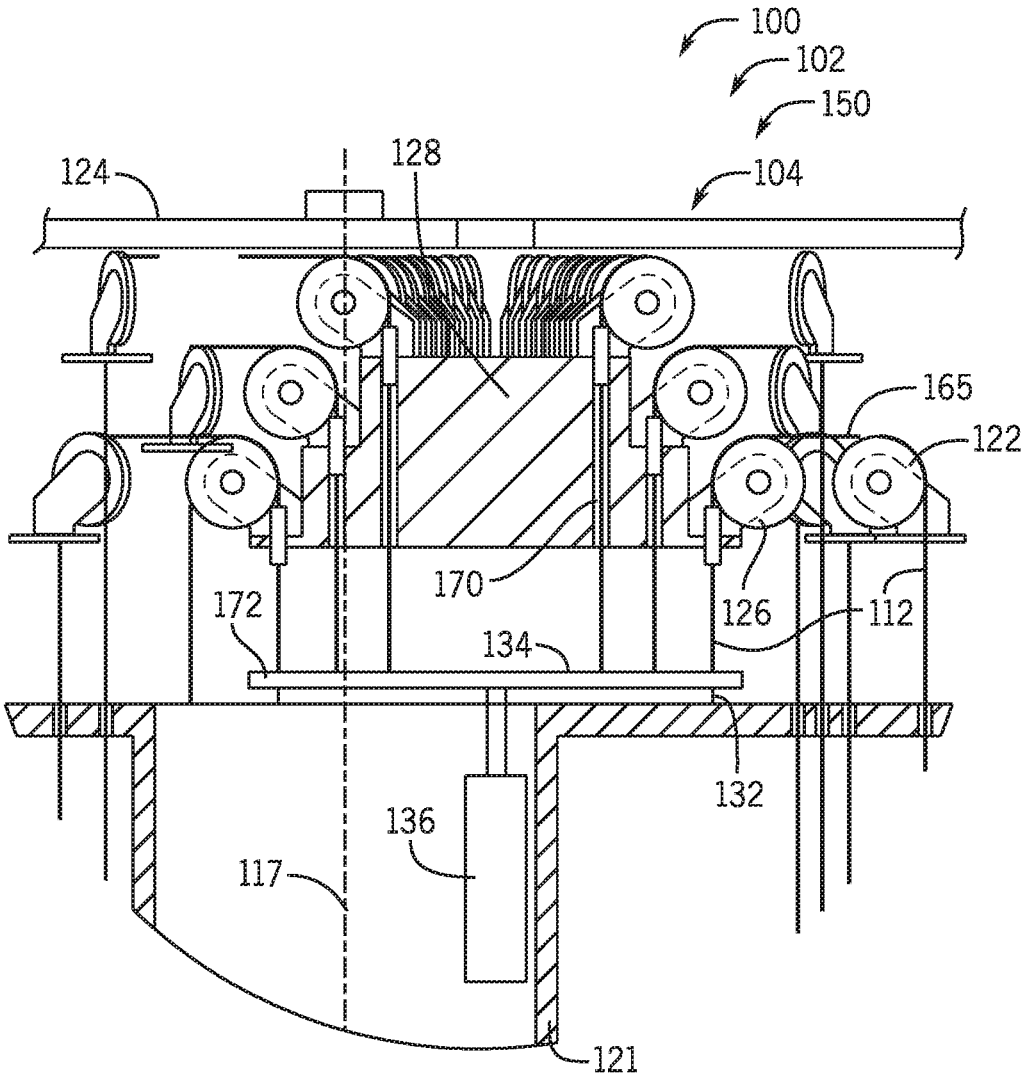
FIG. 9 is a side cross-sectional view of the shuttle assembly of FIG. 6, in accordance with an embodiment of the present disclosure.
Figure 10:
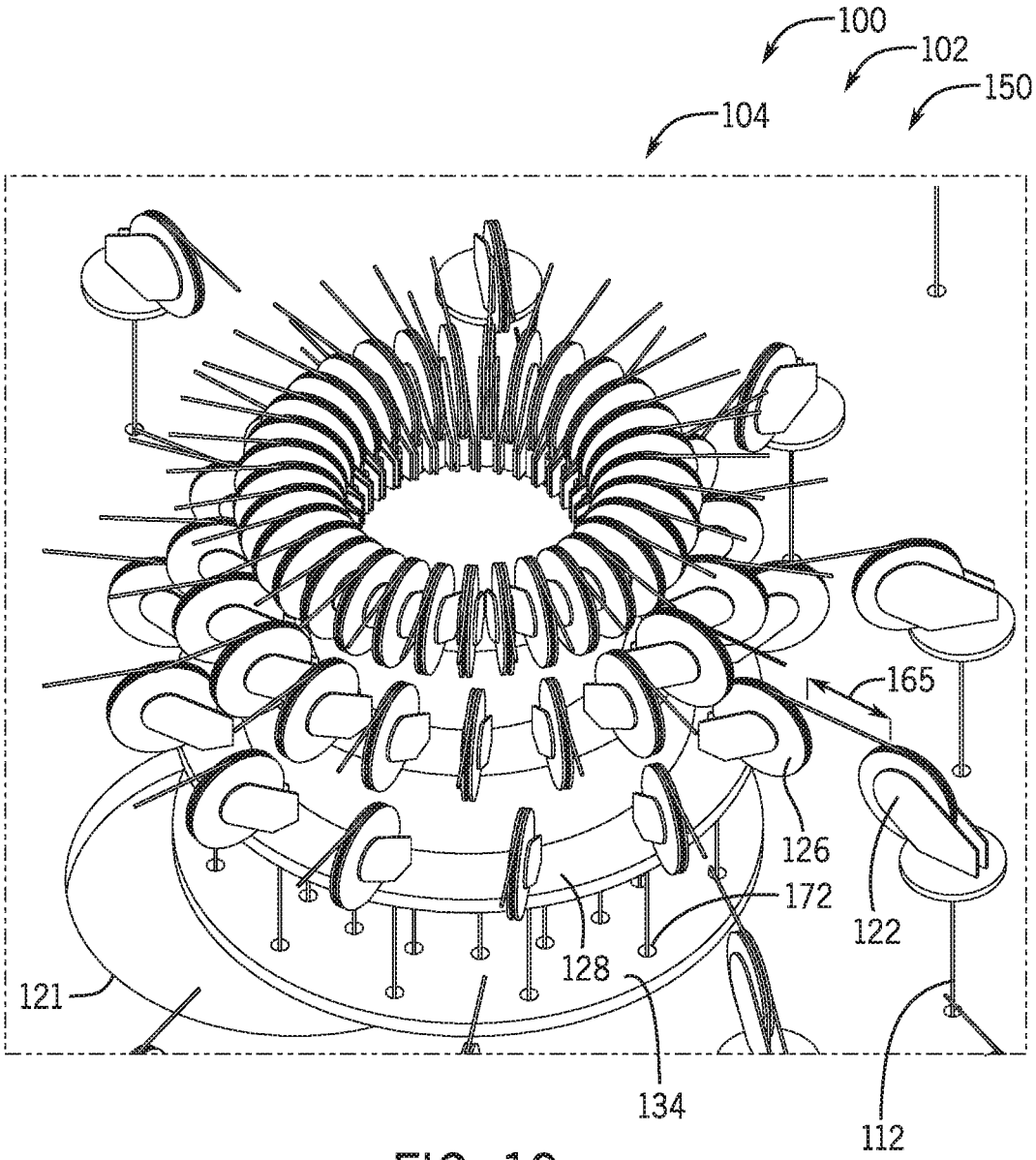
FIG. 10 is a perspective view of the shuttle assembly of FIG. 6, in accordance with an embodiment of the present disclosure.

FIG. 9 is a side cross-sectional view of the shuttle assembly 104, and FIG. 10 is a perspective view of the shuttle assembly 104. As shown, each of the cables 112 extends about the respective first pulley 122 and the respective second pulley 126. Each of the cables 112 includes the respective second end 132, which may have passed through the support block 128 to couple to the plate 134. As shown, the support block 128 may include a respective conduit or opening 170 for each of the cables 112, and the plate 134 may be a perforated plate with multiple openings 172 for each of the cables 112. Thus, the cables 112 may be covered by the support block 128 and/or securely attached to the plate 134 (e.g., by extending through the multiple openings 172 and attaching to a lower surface of the plate 134). In some embodiments, the plate 134 is coupled to the actuator 136, which may raise and lower the plate 134 relative to the support block 128 to move the multiple FIG. 106 in the manner described with respect to FIG. 7. Additionally, as shown, the second pulleys 126 may be supported at discrete locations about the circumference of the support block 128 and are supported at multiple tiers (e.g., vertical levels or steps) of the support block 128. This configuration may enable the lift system 102 to adjust the position of a large number of FIG. 16 and resist cable entanglement.

In operation, the carousel ride system 100 may continuously move between loading operations, ride operations, and unloading operations. The disclosed lift system 102 may enable efficient transition between loading operations, ride operations, and unloading operations, such as by making it easier for riders to climb onto and off of the multiple FIG. 16. For example, during loading operations, the rotatable platform 114 may be stationary and the lift system 102 may be in the load/unload position 120 in which the shuttle assembly 104 is aligned with and centered relative to the rotatable platform 114. Thus, the multiple FIG. 106 are all at the same vertical height 118 relative to the rotatable platform 114 along the vertical axis 123.

Once the riders have climbed onto the multiple FIG. 106, the lift system 102 may optionally adjust the multiple FIG. 16 to the intermediate position 138. Additionally or alternatively, the lift system 102 may adjust to the ride position 150 in which the shuttle assembly 104 is laterally offset from the rotatable platform 114, the multiple FIG. 106, and/or the center post 121 of the carousel ride system 100 along the lateral axis 153. Due to the laterally offset position of the shuttle assembly 104 and the resulting varying distances 65 between each respective pair of the pulleys 122, 126 during rotation, the multiple FIG. 106 may move up and down relative to the rotatable platform 114 along the vertical axis 123 during rotation. In some embodiments, the laterally offset position of the shuttle assembly 104 may change during the ride operations. For example, the shuttle assembly 104 may move to multiple different offset positions relative to the rotatable platform 114, the multiple FIG. 106, and/or the center post 121 of the carousel ride system 100 (e.g., at different distances from the centered position and/or at different locations about the circumference of the center post 121) during the ride operations. In some embodiments, the laterally offset position and/or movement of the shuttle assembly 104 may vary during separate ride operations. Such configurations may provide a more varied and/or unpredictable up and down motion during the ride operations.

Following the ride operations, the rotatable platform 114 may cease rotating and may move to a stationary position for unloading operations. Then, the lift system 102 may adjust to the load/unload position 120 by shifting the shuttle assembly 104 to be aligned with and centered relative to the rotatable platform 114. Thus, the multiple FIG. 106 (e.g., all the multiple FIG. 106 that were raised and lowered by the lift system 102 during the ride operations) are all at the same vertical height 118 relative to the rotatable platform 114 along the vertical axis 123 to facilitate unloading of the carousel ride system 100.

As noted above, in some embodiments, the actuator 136 may adjust the plate 134 to move the multiple FIG. 106 to the another same vertical height 142 after the loading operations and prior to the ride operations. It should be appreciated that the above-described steps to transition between the loading operations, the ride operations, and the unloading operations may be carried out in any suitable order and/or simultaneously. For example, once the riders have climbed onto the multiple FIG. 106, the rotatable platform 114 may rotate prior to or while the lift system 102 adjusts to the ride position 150. Similarly, following the ride operations, the rotatable platform 114 may cease rotation or slow rotation after or while the lift system 102 adjusts to the load/unload position 120.

Additionally, it should be appreciated that the rotation of the rotatable platform 114 and the adjustment of the lift system 102 may be coordinated and controlled by a control system (e.g., electronic control system). For example, with reference to FIG. 8, a control system 180 may include a controller 182 having a processor 184 and a memory device 186. The controller 182 may provide control signals to one or more actuators, such as the actuator 136 to adjust the plate 134 as described above with respect to FIG. 7. The controller 182 may provide control signals to one or more actuators 188 that drive the movement (e.g., lateral movement and/or rotation) of the shuttle assembly 104 to adjust the lift system 102 between the illustrated ride position 150 and the load/unload position 120 (FIG. 6). The controller 182 may provide control signals to one or more actuators 190 that drive the rotation of the rotatable platform 114 and/or rotation of other components (e.g., the ceiling structure 124 and the attached first pulleys 122). The controller 182 may be configured to receive inputs via an input device 192 (e.g., from a ride operator) and to provide the control signals to the actuators 136, 188, 190 in response to the inputs. For example, the controller 182 may receive an input that indicates that the riders have climbed on the multiple FIG. 106 and that the loading operations are complete. In response, the controller 182 may provide the control signals to the one or more actuators 188 to adjust the lift system 102 to the ride position 150, and then at some subsequent time (e.g., after the lift system 102 reaches the ride position 150) the controller 182 may provide the control signals to the one or more actuators 188, 190 to drive rotation of the shuttle assembly 104, the rotatable platform 114, and the other components. As noted above, the steps to transition between the loading operations and the ride operations may be carried out in any suitable order and/or simultaneously. For example, in response to receipt of the input that the loading operations are complete, the controller 182 may provide the control signals to the actuators 188, 190 to drive rotation of the components prior to or while the lift system 102 adjusts to the ride position 150.

Certain steps may be automated and/or controlled on a timer (e.g., timed schedule). For example, once rotation of the rotatable platform 114 commences, the rotation may continue for a time period (e.g., predetermined or operator-set time period, such as 1, 2, 3, 4, 5, or more minutes). When the time period ends, the controller 182 may provide the control signals to the one or more actuators 188, 190 to stop rotation for unloading operations. Then, at some subsequent time (e.g., after the rotatable platform 114 and the other components are stationary), the controller 182 may provide the control signals to the one or more actuators 188 to adjust the lift system 102 to the load/unload position 120 in which the shuttle assembly 104 is aligned with and centered relative to the rotatable platform 114. As noted above, the steps to transition between the ride operations and the unloading operations may be carried out in any suitable order and/or simultaneously. For example, following the ride operations, the controller 182 may provide the control signals to the actuators 188, 190 to stop or to slow rotation of the rotatable platform 114 after or while the lift system 102 adjusts to the load/unload position 120. It should be appreciated that the various actuators 136, 188, 190 are merely exemplary and any number and type of actuators may be positioned at any suitable locations about the carousel ride system 100 to enable the disclosed techniques.

The memory device 186 may include one or more tangible, non-transitory, computer-readable media that store instructions executable by the processor 184 and/or data (e.g., time periods). For example, the memory device 186 may include random access memory (RAM), read only memory (ROM), rewritable non-volatile memory such as flash memory, hard drives, optical discs, and/or the like. Additionally, the processor 184 may include one or more general purpose microprocessors, one or more application specific processors (ASICs), one or more field programmable gate arrays (FPGAs), or any combination thereof.

Figure 11:
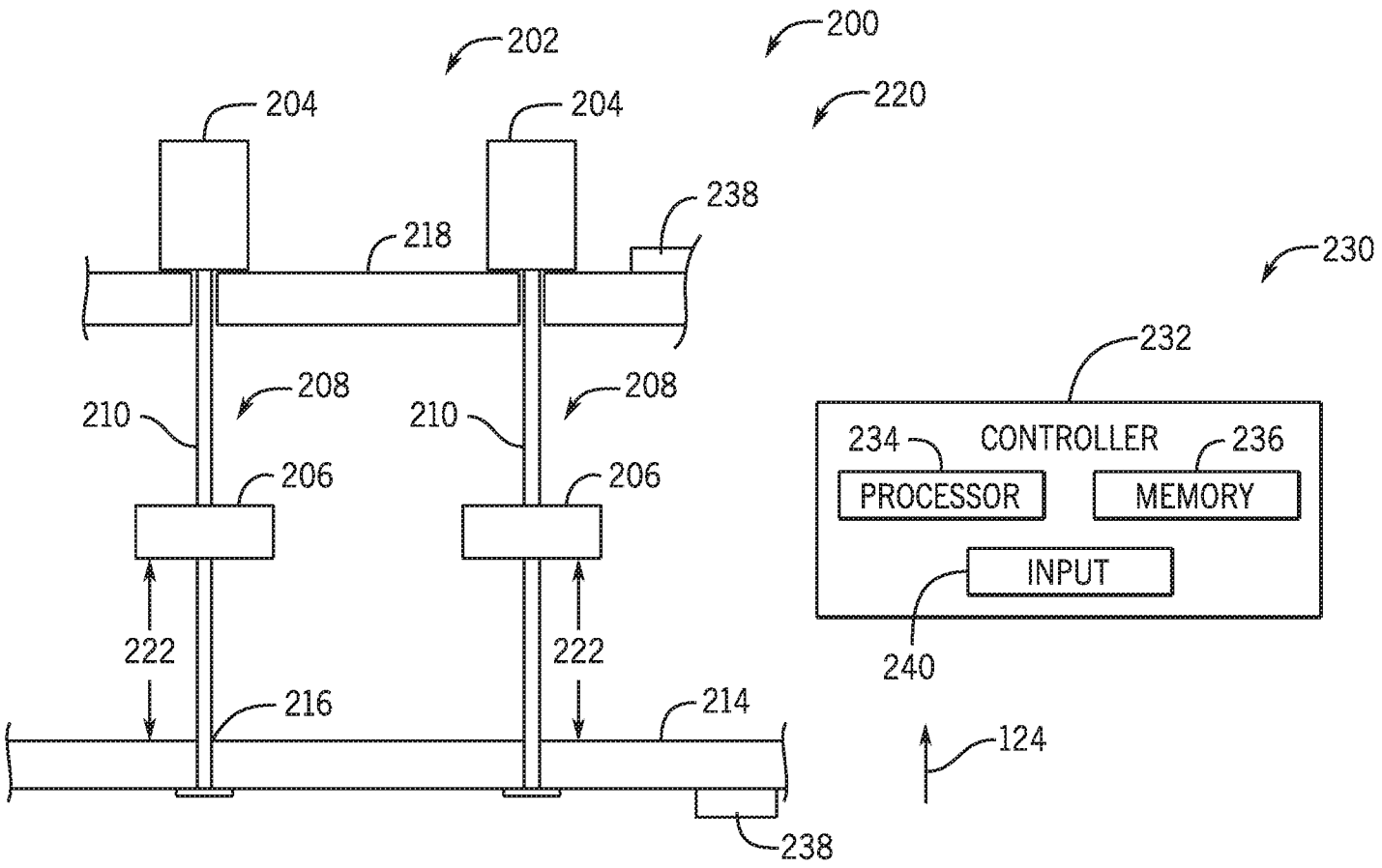
FIG. 11 is a side view of an embodiment of a carousel ride system that includes a lift system having a plurality of actuators, in accordance with an embodiment of the present disclosure.

FIG. 11 is a side view of an embodiment of a carousel ride system 200 that includes a lift system 202 having a plurality of actuators 204. As shown, the carousel ride system 200 also includes multiple FIG. 206 (e.g., seats for riders) each supported by or mounted on a respective support system 208, which may include a respective support post 210 (e.g., rigid post and/or flexible cable). The carousel ride system 200 may also include a rotatable platform 214 on which the riders travel (e.g., walk) to reach the multiple FIG. 206 during loading and unloading operations. Each support post 210 may be coupled to the rotatable platform 214 and/or extend through a respective opening 216 in the rotatable platform 214, and thus, rotation of the rotatable platform 214 about an axis of rotation (e.g., center axis) drives rotation of the multiple FIG. 206.

Each of the plurality of actuators 204 may be configured to individually drive movement of one of the multiple FIG. 206. For example, each of the plurality of actuators 204 may include a linear actuator that is supported by a ceiling structure 218 (e.g., frame) and that operates to raise and to lower the respective support post 210 and the attached respective FIG. 206 relative to the rotatable platform 214 as the rotatable platform 214 rotates during ride operations. As another example, each of the plurality of actuators 204 may include a rotary actuator that rotates a spool to alternately wind and unwind the respective support post 210 (e.g., flexible cable) to raise and to lower the respective FIG. 206 relative to the rotatable platform 214 as the rotatable platform 214 rotates during ride operations. It should be appreciated that the plurality of actuators 204 may be supported by or positioned at or vertically below the rotatable platform 214.

In operation, the carousel ride system 200 may continuously move between loading operations, ride operations, and unloading operations. The disclosed lift system 202 may enable efficient transition between loading operations, ride operations, and unloading operations, such as by making it easier for riders to climb onto and off of the multiple FIG. 206. For example, during loading operations, the rotatable platform 214 may be stationary and the lift system 202 may be in a load/unload position 220 in which the multiple FIG. 206 are positioned at a same vertical height 222 relative to the rotatable platform 214 along a vertical axis 224 of the carousel ride system 200. The vertical axis 224 may be parallel to the axis of rotation of the rotatable platform 224. Once the riders have climbed onto the multiple FIG. 206, the lift system 202 may operate the plurality of actuators 204 to move the multiple FIG. 206 up and down relative to the rotatable platform 214 along the vertical axis 123 during rotation of the rotatable platform 214. Following the ride operations, the rotatable platform 214 may cease rotating and may move to a stationary position for unloading operations. Then, the lift system 202 may adjust to the load/unload position 220 to position the multiple FIG. 206 (e.g., all the multiple FIG. 206 that were raised and lowered by the lift system 202 during the ride operations) at the same vertical height 222 relative to the rotatable platform 214 along the vertical axis 224 to facilitate unloading of the carousel ride system 200.

It should be appreciated that the above-described steps to transition between the loading operations, the ride operations, and the unloading operations may be carried out in any suitable order and/or simultaneously. For example, once the riders have climbed onto the multiple FIG. 206, the rotatable platform 214 may rotate prior to or while the lift system 202 adjusts to the ride position. Similarly, following the ride operations, the rotatable platform 214 may cease rotation or slow rotation after or while the lift system 202 adjusts to the load/unload position 220.

Additionally, it should be appreciated that the rotation of the rotatable platform 214 and the adjustment of the lift system 202 may be coordinated and controlled by a control system (e.g., electronic control system). For example, with reference to FIG. 11, a control system 230 may include a controller 232 having a processor 234 and a memory device 236. The controller 232 may provide control signals to the plurality of actuators 204 to individually raise and lower the multiple FIG. 206. The controller 232 may also provide control signals to one or more actuators 238 that drive the rotation of the rotatable platform 214 and/or rotation of other components (e.g., the ceiling structure 218). The controller 232 may be configured to receive inputs via an input device 240 (e.g., from a ride operator) and to provide the control signals to the actuators 204, 238 in response to the inputs. For example, the controller 232 may receive an input that indicates that the riders have climbed on the multiple FIG. 206 and that the loading operations are complete. In response, the controller 232 may provide the control signals to the plurality of actuators 204 to raise and to lower the multiple FIG. 206 relative to the rotatable platform 214 and to the one or more actuators 238 to drive rotation of the rotatable platform 214 and the other components. As noted above, the steps to transition between the loading operations and the ride operations may be carried out in any suitable order and/or simultaneously.

Certain steps may be automated and/or controlled on a timer (e.g., timed schedule). For example, once rotation of the rotatable platform 214 commences, the rotation may continue for a time period (e.g., predetermined or operator-set time period, such as 1, 2, 3, 4, 5, or more minutes). When the time period ends, the controller 232 may provide the control signals to the one or more actuators 238 to stop rotation for unloading operations. The controller 232 may also provide the control signals to the plurality of actuators 238 to adjust the lift system 202 to the load/unload position 220 in which the multiple FIG. 206 are all at the same vertical height 222 relative to the rotatable platform 214. As noted above, the steps to transition between the ride operations and the unloading operations may be carried out in any suitable order and/or simultaneously. It should be appreciated that the various actuators 204, 238 are merely exemplary and any number and type of actuators may be positioned at any suitable locations about the carousel ride system 200 to enable the disclosed techniques.

The memory device 236 may include one or more tangible, non-transitory, computer-readable media that store instructions executable by the processor 234 and/or data (e.g., time periods). For example, the memory device 236 may include random access memory (RAM), read only memory (ROM), rewritable non-volatile memory such as flash memory, hard drives, optical discs, and/or the like. Additionally, the processor 234 may include one or more general purpose microprocessors, one or more application specific processors (ASICs), one or more field programmable gate arrays (FPGAs), or any combination thereof.

Figure 12:
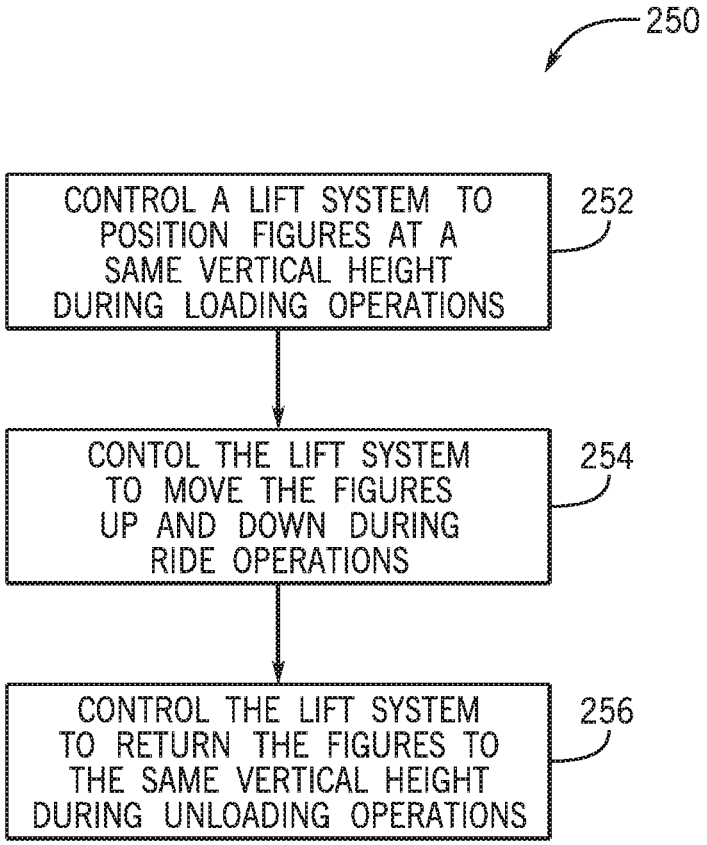
FIG. 12 is a flow diagram of a method of operating a carousel ride system having a lift system, in accordance with an embodiment of the present disclosure.

FIG. 12 is a flow diagram of an embodiment of a method 250 of operating a carousel ride system, including any of the carousel ride systems disclosed herein. The method 250 disclosed herein includes various steps represented by blocks. It should be noted that at least some steps of the method 250 may be performed as an automated procedure by a system, such as any of the control systems disclosed herein. Although the flow chart illustrates the steps in a certain sequence, it should be understood that the steps may be performed in any suitable order and certain steps may be carried out simultaneously, where appropriate. Additionally, steps may be added to or omitted from the method 250.

In step 252, a lift system may be controlled to position multiple figures at a same vertical height relative to a rotatable platform of a carousel ride system during loading operations. In step 254, the lift system may be controlled to move the multiple figures up and down relative to the rotatable platform along a vertical axis during rotation of the rotatable platform and the multiple figures during ride operations. For example, each of the multiple figures may be at varying vertical heights relative to the rotatable platform along the vertical axis during the ride operations. In particular, a respective vertical height of a first figure of the multiple figures may vary during the ride operations, and the respective vertical height of the first figure of the multiple figures may be different from a respective vertical height of a second figure of the multiple figures at certain times and/or throughout the ride operations. In step 256, the lift system may be controlled to return the multiple figures to the same vertical height relative to the rotatable platform during unloading operations. Additional details of the method 250 may be understood with reference to FIGS. 1-11 and the corresponding description.

While only certain features of present embodiments have been illustrated and described herein, many modifications and changes will occur to those skilled in the art. It is, therefore, to be understood that the appended claims are intended to cover all such modifications and changes that fall within the true spirit of the disclosure. Further, it should be understood that certain elements of the disclosed embodiments may be combined or exchanged with one another.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A carousel ride system, comprising:

a rotatable platform;

a plurality of figures that are configured to rotate with the rotatable platform, wherein each figure of the plurality of figures is supported on a respective support post that extends vertically through a respective opening in the rotatable platform; and a lift system that is configured to raise and to lower the plurality of figures relative to the rotatable platform along a vertical axis during ride operations and to position the plurality of figures at a same vertical height relative the rotatable platform along the vertical axis during loading and unloading operations.

2. The carousel ride system of claim 1, wherein the lift system comprises a track that is configured to move relative to the rotatable platform along the vertical axis.

3. The carousel ride system of claim 2, wherein the track comprises an annular track having one or more undulations that extend circumferentially about the annular track.

4. The carousel ride system of claim 2, wherein the respective support post is coupled to a respective bogie.

5. The carousel ride system of claim 4, wherein the respective bogie comprises at least one wheel that is configured to be supported on a support frame during the loading and unloading operations and at least one other wheel that is configured to be supported on the track during the ride operations.

6. The carousel ride system of claim 2, wherein the lift system comprises a support frame positioned vertically below the rotatable platform, the support frame comprising a gap, and the track is configured to move through the gap along the vertical axis.

7. The carousel ride system of claim 1, wherein the lift system comprises a shuttle assembly that is configured to be in a central position relative to an axis of rotation of the rotatable platform during the loading and unloading operations and that is configured to be in a laterally offset position relative to the axis of rotation of the rotatable platform during ride operations.

8. The carousel ride system of claim 7, wherein the lift system comprises a plurality of pulleys coupled to the shuttle assembly and supporting a plurality of cables, and each cable of the plurality of cables comprises a respective first end portion coupled to a respective figure of the plurality of figures and a respective second end portion coupled to the shuttle assembly.

9. The carousel ride system of claim 8, wherein the respective first end portion of each cable of the plurality of cables is coupled to the respective figure of the plurality of figures via the respective support post.

10. The carousel ride system of claim 1, wherein the lift system comprises a plurality of actuators, and each actuator of the plurality of actuators is associated with a respective figure of the plurality of figures and is configured to independently drive movement of the respective figure of the plurality of figures relative to the rotatable platform along the vertical axis.

11. The carousel ride system of claim 10, wherein the plurality of actuators comprise a plurality of linear actuators.

12. A method of operating a carousel ride system, the method comprising:

positioning, using a lift system, a plurality of figures at a same vertical height relative to a rotatable platform along a vertical axis during loading operations, wherein each figure of the plurality of figures is supported on a respective support post that extends vertically through a respective opening in the rotatable platform;

moving, using the lift system, the plurality of figures up and down relative to the rotatable platform along the vertical axis during rotation of the rotatable platform and the plurality of figures during ride operations; and positioning, using the lift system, the plurality of figures to the same vertical position relative to the rotatable platform along the vertical axis during unloading operations.

13. The method of claim 12, comprising moving a track of the lift system relative to the rotatable platform along the vertical axis.

14. The method of claim 13, comprising rolling wheels of bogies coupled to the plurality of figures along the track to enable movement of the plurality of figures up and down relative to the rotatable platform along the vertical axis during rotation of the rotatable platform and the plurality of figures during the ride operations.

15. The method of claim 14, wherein moving the track of the lift system comprises moving the track through a gap formed in a support frame positioned below the rotatable platform along the vertical axis.

16. The method of claim 15, comprising supporting other wheels of the bogies on the support frame to position the plurality of figures at the same vertical height during the loading operations and the unloading operations.

17. The method of claim 12, comprising adjusting a shuttle assembly of the lift system from a central position relative to an axis of rotation of the rotatable platform to a laterally offset position relative to the axis of rotation of the rotatable platform.

18. The method of claim 17, comprising sliding cables coupled to the plurality of figures over a plurality of shuttle pulleys coupled to the shuttle assembly to enable movement of the plurality of figures up and down relative to the rotatable platform along the vertical axis during rotation of the rotatable platform and the plurality of figures during the ride operations.

19. The method of claim 12, comprising adjusting a plurality of actuators that are each associated with a respective figure of the plurality of figures to independently drive movement of the plurality of figures.

20. A carousel ride system, comprising:

a rotatable platform;

a plurality of figures that are configured to rotate with the rotatable platform, wherein each figure of the plurality of figures is supported on a respective support post that extends vertically through a respective opening in the rotatable platform; and a lift system comprising a controller, wherein the controller is configured to control one or more actuators of the lift system to adjust one or more components of the lift system to cause the plurality of figures to repeatedly move up and down relative to the rotatable platform along a vertical axis during ride operations and to cause the plurality of figures to be at a same vertical height relative to the rotatable platform during loading and unloading operations.

* * * * *